United States Patent [19]

Johnson

[11] Patent Number: 4,835,800

[45] Date of Patent: Jun. 6, 1989

[54] SECTIONAL MATTRESS FOR TENT

[76] Inventor: Terrance D. Johnson, 301 N. Rogers, Aberdeen, Wash. 98520

[21] Appl. No.: 134,015

[22] Filed: Dec. 17, 1987

[51] Int. Cl.[4] ..... A46G 9/06; A47C 27/00

[52] U.S. Cl. ..... 5/420; 5/465

[58] Field of Search ..... 5/417, 420, 448, 449, 5/457, 465; 52/2 R, 2 K; 135/116; 428/33

[56] References Cited

U.S. PATENT DOCUMENTS

| | | | |
|---|---|---|---|
| 252,973 | 1/1882 | Schenk | 5/465 |
| 1,624,797 | 4/1927 | Morehouse | 5/417 |
| 2,731,652 | 1/1956 | Bishop | 5/457 X |
| 4,091,149 | 5/1978 | Oxendine | 5/417 X |

FOREIGN PATENT DOCUMENTS

| | | | |
|---|---|---|---|
| 593653 | 12/1977 | Switzerland | 135/116 |

*Primary Examiner*—Alexander Grosz

*Assistant Examiner*—Michael F. Trettel

*Attorney, Agent, or Firm*—Joan H. Pauly

[57] ABSTRACT

Three mattress sections (22, 26, 34) are arranged together in use positions to substantially cover the entire floor area (10) of a hexagonal tent (2). The separate third section (34) covers a portion (12) of the floor area (10) adjacent to the tent opening (6). This portion (12) extends across the opening (6) and inwardly therefrom a distance sufficient to allow a person to step into the tent, when the third section (34) is away from its use position, without stepping on the first and second sections (22, 26). The first and second sections (22, 26) may be formed separately, with or without releasable fasteners (32''), or may be permanently connected together by a web (30') which permits them to be folded together. In inflatable embodiments, the valves (24, 28, 36) are preferably positioned to facilitate inflation and minimize their exposure to damage. The mattress may also have other configurations, such as rectangular.

13 Claims, 2 Drawing Sheets

SECTIONAL MATTRESS FOR TENT

DESCRIPTION

1. Technical Field

This invention relates to mattresses for use in tents and, more particularly, to such a mattress which has separately usable sections that substantially cover the floor area of the tent, one such section having a use position adjacent to the entry opening in the tent and being formed separately from the other sections to allow it to be separately removable from its use position to in turn allow persons to step into the tent without stepping on any portion of the mattress.

2. Background Art

In recent years, camping has become increasingly popular as a social and family activity. One of the more popular camping arrangements is to use a tent to provide sleeping quarters and shelter from the elements. Unfortunately, the manner in which tents are generally used and the currently available mattresses and pads are not designed to maximize either the versatility of the tent or the comfort of persons sleeping in the tent. For example, the mattresses, pads and sleeping bags currently available are not designed to make maximum use of the available floor space in tents. This is particularly true in relation to the currently popular hexagonally shaped tents. Another problem that arises in relation to known mattress and/or pad arrangements for tents is that, during the day, the mattress or pad is exposed to damage by people stepping thereon when entering the tent.

U.S. Pat. No. 4,665,575, granted May 19, 1987, to D. A. Raught, discloses an array of innerspring mattress modules that can be arranged to fit a floor area available for sleeping in a boat, motor home, or recreational vehicle. The modules are provided with screened openings which are positioned adjacent to openings of adjacent modules for ventilation of the modules to prevent accumulation of moisture.

U.S. Pat. No. 4,631,765, granted Dec. 30, 1986, to S. D. Casey, discloses guilted modules for forming bed covers, cushions, ground covers, sleeping bags, etc. The modules are of regular geometric shapes and are detachably connectable by snaps or a cord to form various shapes.

U.S. Pat. No. 4,459,714, granted July 17, 1984, to J. P. Lin, discloses separate air or water cushions connectable together by, for example, rings or cords to form a lounge, raft, life jacket, chair, etc. As shown, each cushion has an intake valve in the top surface of the middle portion of one side.

U.S. Pat. No. 3,428,974, granted Feb. 25, 1969, to J. C. Stuart, discloses an inflatable mattress with separately inflatable rectangular compartment that are detachably connected together by side fasteners, zippers, or snaps. The inflation valves are described as being located in a sidewall and are shown in the lateral centers of the sidewalls. Stuart states that the compartments may be used as separable cushions and describes the compartments as being readily connectable regardless of their arrangement with respect to each other.

U.S. Pat. No. Des. 179,241, granted Nov. 20, 1956, to E. D. Burton et al., discloses a design for an irregularly shaped inflatable mattress which apparently includes three laterally extending generally rectangular guilted segments that are attached together. The drawing appears to show a valve positioned on the bottom of each of two of the segments adjacent to another segment. U.S. Pat. No. 4,054,960, granted Oct. 25, 1977, to J. E. Pettit et al., disclosed an air mattress for pregnant women having openings to relieve pressure on certain body portions, and a plug to fill in one of said openings. U.S. Pat. No. Des. 270,800, granted Oct. 4, 1983, to J. T. Fuller, discloses a design for play cushions with various geometrical shapes that nest together to form a rectangle.

Irregularly shaped pillows, cushions, or mattresses are disclosed in U.S. Pat. No. Des. 204,444, granted Apr. 19, 1966, to W. M. Emery; and No. 3,416,169, granted Dec. 17, 1968, to W. M. Emery. U.S. Pat. No. Des. 292,356, granted Oct. 20, 1987, to O. D. Veneman discloses a design for an octagonal back pillow. Page 24 of the July 1983 issue of "Waterbed Magazine" includes an ad for custom made water mattresses that shows several mattresses having regular and irregular geometric shapes. U.S. Pat. No. 3,968,529, granted July 13, 1976, to M. Levin et al., discloses a decorative pillow arrangement having connected triangular sections that can be folded into various shapes, including a hexagon.

The disclosures in the literature discussed above and the prior art that is discussed and/or cited therein should be studied for the purpose of putting the present invention into proper perspective relative to the prior art.

DISCLOSURE OF THE INVENTION

The subject to the invention is a sectional mattress for a tent having sidewalls with an entry opening therein and lower portions that define a floor area. According to an aspect of the invention, the mattress comprises a first section, a second section, and a third section separate from the first and second sections. The first, second, and third sections each have a use position on the floor area. The first, second, and third sections are shaped and dimensioned to cover substantially the entire extent of the floor area when they are in their use positions. The third section is shaped and dimensioned to cover, when it is in its use position, a portion of the floor area adjacent to the opening. This portion of the floor area extends laterally at least substantially all the way across the opening, and inwardly from the opening a distance sufficient to allow a person entering the tent, when the first and second sections are in their use positions and the third section is away from its use position, to step into the tent without stepping on the first and second sections.

The first and second sections may be formed separately to permit them to be used separately and to permit temporary removal of one of them from its use position to clear part of the floor area of the tent. The cleared part of the floor area may be used for stowing heavy gear which might damage the mattress if placed on top of the mattress, for playing rainy day games, or for other activity. Embodiments of the mattress having first and second sections formed separately may also include the feature of releasable fastening means carried by the first and second sections for releasably connecting the first and second sections to each other. Such fastening means helps to maintain the sections in proper relationship to each other and to prevent minor differences in the dimensions of the mattress and the dimensions of the floor area, or the absence of the third section, from affecting the relative continuity and comfort of the sleeping surface.

An alternative to providing separately formed first and second sections is to provide first and second sections that are attached to each other by a web positioned to allow one of the first and second sections to be folded under the other. The web maintains the first and second sections in proper relation to each other. The positioning of the web to permit folding of the sections permits a part of the floor area to be cleared for various uses, as discussed above is connection with separately formed first and second sections. In a preferred embodiment of the invention, the first and second sections are separately inflatable to allow one of them to be deflated and folded under the other.

The mattress of the invention and the sections thereof may take various forms. They may be, for example, conventional air mattresses, self-inflating foam-filled air mattresses, single foam pads, or some other suitable structure. In the embodiments of the mattress in which the sections are inflatable, each of the first, second, and third sections preferably has an inflation valve for separate inflation thereof. The valve of the first and second sections is positioned to be proximate to the sidewalls of the tent and the portion of the floor area covered by the third section. The valve of the third section is positioned to be proximate to a side edge of the tent opening. This positioning of the valves facilitates inflation of the first, second, and third sections when they are in their use positions and minimizes their exposure to damage by persons using the tent.

The mattress of the invention may be made to substantially cover the floor area of tents with various configurations. In a preferred embodiment of the invention, the mattress is shaped to cover a hexagonal floor area. This embodiment provides a simple, economical, and easy to use means for maximizing the use of the floor space for sleeping and maximizing the comfort of persons sleeping in the tent.

Mattresses constructed in accordance with the invention have a relatively simple structure, are easy to handle, and are very versatile. Whatever the shape of the floor area, the mattress allows maximization of the utilization of the floor space for sleeping and other purposes. The configuration of the sectional mattress of the invention maximizes the use of the floor area for sleeping and helps maximize the comfort of persons lying on the mattress. In addition, the configuration permits conversion to a configuration which accommodates activity with minimum effort. The removal of the third section from its use position allows persons to enter the tent comfortably without stepping on the mattress and thereby subjecting it to damage or unnecessary wear. In the preferred embodiments of the invention, an additional part of the floor area may be easily cleared to provide storage space or to permit activity, as described above.

These and other advantages and features will become apparent from the detailed description of the best modes for carrying out the invention which follows.

BRIEF DESCRIPTION OF THE DRAWINGS

In the drawings, like element designations refer to like parts throughout, and.

BEST MODES FOR CARRYING OUT THE INVENTION

Figure 1:
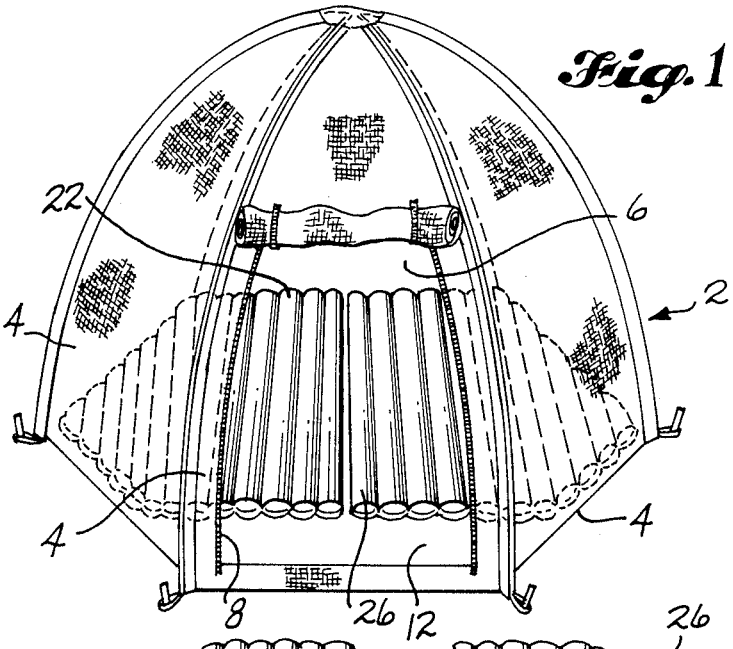
FIG. 1 is a pictorial view of a hexagonal tent with a preferred embodiment of the first and second sections positioned therein in their use positions.
Figure 2:
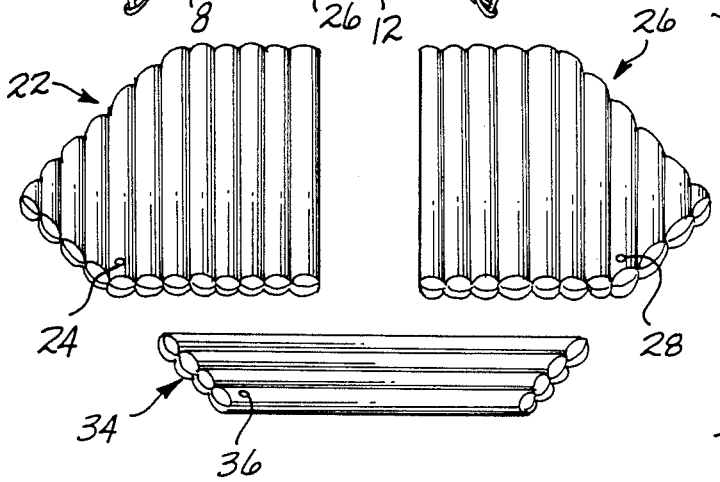
FIG. 2 is pictorial view of the three sections of the preferred embodiment, the first and second sections of which are shown in FIG. 1.
Figure 3:
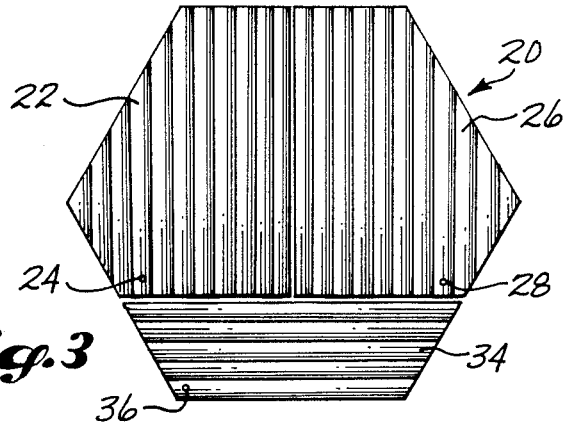
FIG. 3 is a top plan view of the sections shown in FIG. 2 positioned as they would be in their use positions in the tent shown in FIG. 1.

The drawings show two embodiments of a sectional mattress 20, 120 and modified forms of the mattress 20. The mattresses 20, 120, including the modifications shown in the drawings, are constructed in accordance with the invention and constitute the best modes for carrying out the invention currently known to the applicant. It is anticipated that the mattress of the invention will primarily be used in the configurations shown in the drawings and that a primary method of forming the sections will be as air inflatable sections as shown in the drawings. However, it is of course to be understood that the mattress of the invention may also be provided with sections that form a different configuration and with a section or sections that are either not inflatable or are constructed to be inflated in a manner different from the sections shown in the drawings.

Figure 4:
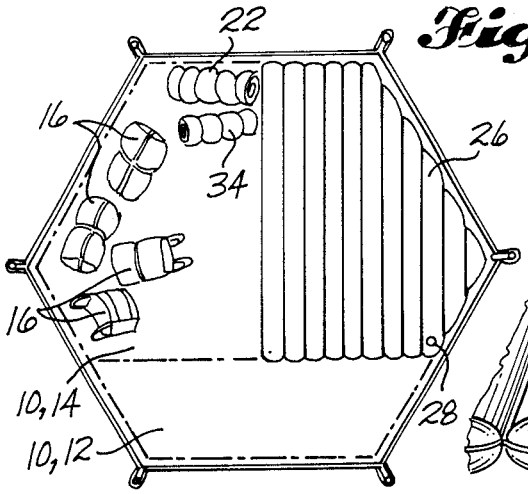
FIG. 4 is a top plan view of the floor area of the tent shown in FIG. 1 and the mattress shown in FIGS. 2 and 3, with the second section in its use position and the separate first and third sections in stowed positions with other gear.

A hexagonal tent 2 is shown in FIGS. 1 and 4 for the purpose of illustrating the use of the first preferred embodiment of the invention shown in FIGS. 1–4. The tent 2 has sidewalls 4 with an entry opening 6 therein. The lower portions of the sidewalls 4 define a floor area 10. This floor area 10 would normally be the upper surface of a bottom of the tent 2 attached to the sidewalls 4, but could also be the ground surface in the case of a tent without a bottom. The hexagonal shape of the floor area 10 is most clearly seen in FIG. 4.

Seen first preferred embodiment of the mattress 20 is shown in FIGS. 1–4 and is designed for use in hexagonal tents, such as the tent 2 shown in FIGS. 1 and 4. The mattress 20 includes a first section 22, a second section 26, and a third section 34. As can most clearly be seen in FIG. 2, each of the three sections 22, 26, 34 is formed separately. The third section 34 has a trapezoidal configuration with its shorter parallel side having a length substantially equal to the length of each side of the floor area 10, including the side adjacent to the opening 6. The nonparallel sides of the section 34 are about half the length of each of the sides of the floor area 10. When it is in its use position, the third section 34 rests on the portion 12 of the floor area 10 adjacent to the opening 6, with its shorter parallel side adjacent to the opening 6, its nonparallel sides adjacent to the adjoining sides of the floors area 10, and its longer parallel side adjacent to the first and second sections 22, 26. As shown in the drawings, the first and second sections 22, 26 are preferably mirror images of each other.

FIG. 1 illustrates the use positions of the first and second sections 22, 26, and FIG. 4 illustrates the use positions of each of the three sections 22, 26, 34, with the use positions of the first and third sections 22, 34 shown in phantom. The sections 22, 26, 34 are shaped and dimensioned to cover substantially the entire extent of the floor area 10 when they are in their use positions.

The third section 34 is shaped and dimensioned so that the portion 12 of the floor area 10 of the tent 2 which it covers is sufficiently large to allow a person entering the tent 2, when the first and second sections 22, 26 are in their use positions and the third section 34 is away from its use positions, to step into the tent 2 without stepping on the first and second sections 22, 26. The third section 34 is configured to occupy a portion 12 of the floor area 10 extending laterally at least substantially all the way across the tent opening 6, and inwardly from the opening 6 a distance sufficient to allow such entry. In the preferred embodiment shown in FIGS. 1–4, the shorter parallel side of the third section 34 substantially coincides with the edge of the floor area 10 adjacent to the tent opening 6 and extends all the way across the opening 6 and beyond the opposite side edges 8 of the opening 6. As noted above, the third section 34 and the portion 12 of the floor area 10 which it covers extend inwardly from the opening 6 a distance equal to about half of the distance from the side edge to the center of the floor area 10. FIG. 1 illustrates the first and second sections 22, 26 in their use position with the floor area portion 12 which the third section 34 occupies in its use position clear to permit easy entry into the tent 2.

The separate forming of the first and second sections 22, 26 of the preferred embodiment shown in FIGS. 1–4 permits the sections 22, 26 to be used separately and also permits temporary removal of one of the sections 22, 26 from its use position to clear part of the floor area 10 for other uses. Such uses are discussed above. FIG. 4 illustrates a daytime use configuration of the mattress 20. The second section 26 remains in its use position to enable persons using the tent to rest on the section 26. The first and third sections 22, 34 have been deflated and rolled up. The sections 22, 34 and other gear 16 are shown in stowed positions on the portion 14 of the floor area 10 that is occupied by the first section 22 when it is in its use position. This portion 14 has been cleared by the deflation and rolling up of the first section 22. As can be seen in FIG. 4, a part of the floor area portion 14 is being used for storage, and another part remains available for other activity.

Each of the sections 22, 26, 34 of the mattress 20 shown in FIGS. 1–4 has an inflation valve 24, 28, 36 for separate inflation thereof. The valves 24, 28 of the first and second sections 22, 26 are each positioned on a corner portion of the section 22, 26 which is proximate, when the sections 22, 26 are in their use positions, to the tent sidewalls 4 and the portion 12 of the floor area 10 adjacent to the opening 6. The positioning of the valve 28 of the second section 26 is shown in FIG. 4. The valve 36 of the third section 34 is positioned to be proximate to one of the side edges 8 of the tent opening 6. In the preferred embodiment shown in FIGS. 1–4, the valve 36 is positioned to be just laterally inside the side edge 8. The positioning of the valves 24, 28, 36 facilitates the inflation of the first, second, and third sections 22, 26, 34 when they have been placed in their use positions. The positioning of the valves 24, 28, 36 also helps minimize their exposure to damage by persons using the tent 2. Each valve 24, 28, 36 is in a position in which it is highly unlikely to be stepped or kneeled on but is easily accessible for the purpose of inflation or deflation.

Figure 7:
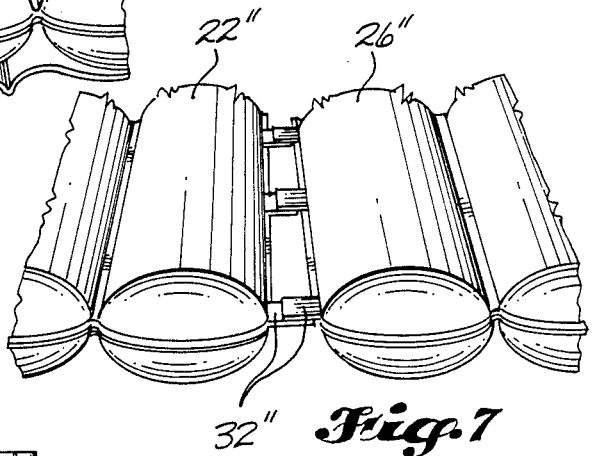
FIG. 7 is like FIG. 5 except that it shows a further modified form of the first and second sections.

FIG. 7 shows a modified form of the mattress 20 shown in FIGS. 1–4. The first and second section 22″, 26″ of the mattress shown in FIG. 7 are separately formed like the mattress 20 shown in FIGS. 1–4. However, the sections 22″, 26″ carry releasable fastening means for releasably connecting them to each other. As shown in FIG. 7, this fastening means may comprises tabs 32″ which secured to each other by means of an interlocking material of a known type, such as the material sold under the trademark VELCRO. Other types of fastening means may, of course, also be used.

Figure 5:
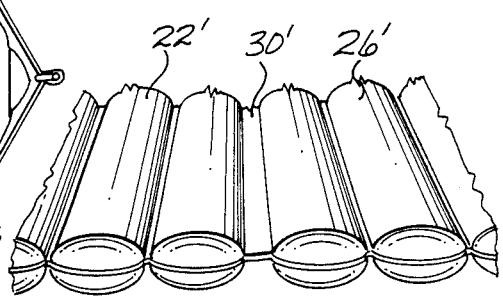
FIG. 5 is a fragmentary pictorial view of the first and second sections of a modified form of the mattress.
Figure 6:
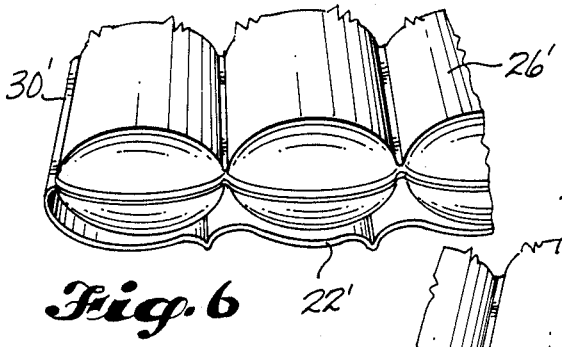
FIG. 6 is fragmentary pictorial view of the sections shown in FIG. 5, with one of the sections deflated and folded under the other.

FIGS. 5 and 6 show another modification of the mattress 20 shown in FIGS. 1–4. In this modification, rather than being separately formed, the first and second sections 22′, 26′ are permanently attached to each other by a web 30′. The web 30′ is positioned to allow one of the sections 22′, 26′ to be folded under the other. Since the sections 22′, 26′ shown in FIGS. 5 and 6 are inflatable, the normal procedure for folding one of them out of the way is to first deflate it and then fold it under the other section. FIG. 6 shows the first section 22′ deflated and folded under the second section 26′. In a use situation similar to the one illustrated in FIG. 4, the deflating and folding procedure illustrated in FIG. 6 may be used to clear a portion of the tent floor area for activity while maintaining a resting surface in the portion of the tent occupied by the second section 26′. In addition to facilitating the use configuration shown in FIG. 4, the separate inflatability of the sections 22′, 26′ makes them easier to handle and helps maintain uniform firmness of the mattress when greater weight is placed on one side than the other.

Figure 8:
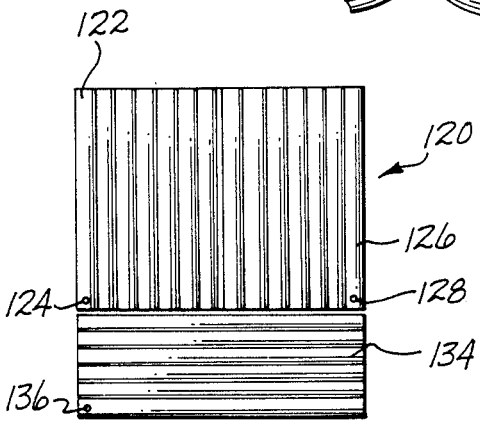
FIG. 8 is like FIG. 3 except that it shows a different preferred embodiment of the invention designed for use in rectangular tents.

FIG. 8 shows another preferred embodiment 120 of the mattress of the invention. Each of the sections 122, 126, 134 of the mattress 120 is rectangular. When they are assembled together in their use positions, as shown in FIG. 8, the sections 122, 126, 134 form a rectangular sectional mattress 120. The sections 122, 126, 134 are arranged in a manner similar to the sections 22, 26, 34 of the mattress 20 shown in FIGS. 1–4. The separately formed third section 134 extends all the way along one side of the rectangle occupied by the mattress 120 and inwardly therefrom part of the way along the adjoining sides. The first and second sections 122, 126 are mirror images of each other and are positioned adjacent to the opposite long side of the third section 134. These sections 122, 126 may be formed separately or may be connected to each other, as discussed above. The valves 124, 128, 136 of the three sections 122, 126, 134 are positioned in the same manner as the valves 24, 28, 36 of the mattress 20.

Althrough the preferred embodiments of the invention have been illustrated and discribed herein, it is intended to be understood by those skilled in the art that various modifications and omissions in form and detail may be made without departing from the spirit and scope of the invention as defined in the following claims.

What is claimed is:

1. A sectional mattress for a tent having sidewalls with an entry opening therein and lower portions that define a floor area, said mattress comprising a first section, a second section, and a third section separate from said first and second sections; said first second, and third sections each having a use position on said floor area; said first, second, and third sections being shaped and dimensioned to cover substantially the entire extent of said floor area when they are in said use positions; and said third section being shaped and dimensioned to cover, when it is in its use position, a portion of said floor area adjacent to said opening; said portion of said floor area extending laterally at least substantially all the way across said opening, and inwardly from said opening a distance sufficient to allow a person entering the tent, when the first and second sections are in their use positions and the third section is away from its use position, to step into the tent without stepping on said first and second sections.

2. A mattress as decribed in claim 1, in which said first and second sections are formed separately to permit them to be used separately and to permit temporary removal of one of them from its use position to clear part of said floor area.

3. A mattress as described in claim 2, further comprising releasable fastening means carried by said first and second sections for releasably connecting said first and second sections to each other.

4. A mattress as described in claim 1, in which said first and second sections are permanently attached to each other by a web positioned to allow one of said first and second sections to be folded under the other.

5. A mattress as described in claim 4, in which said first and second sections are separately inflatable to allow one of them to be deflated and folded under the other.

6. A mattress as described in claim 1, in which each of said first, second, and third sections has an inflation valve for separate inflation thereof; said valve of each of said first and second sections being positioned to be proximate to said sidewalls and said portion of said floor area, and said valve of said third section being positioned to be proximate to a side edge of said opening, to facilitate inflation of said first, second, and third sections when they are in their use positions and to minimize exposure of the valves to damage by persons using the tent.

7. A mattress as described in claim 1, in which said floor area is hexagonal.

8. A mattress as described in claim 1, in which said portion of said floor area extends all the way across said opening and along portions of said sidewalls adjacent to opposite side edges of said opening.

9. A mattress as described in claim 8, in which said first and second sections are shaped and dimensioned to provide a substantially continuous sleeping surface when they are in their use positions and said third section is away is from its use position.

10. A mattress as described in claim 9, in which each of said first, second, and third sections has an inflation valve for separate inflation thereof; said valve of each of said first and second sections being positoned to be proximate to said sidewalls and said portion of said floor area, and said valve of said third section being positioned to be proximate to a side edge of said opening, to facilitate inflation of said first, second, and third section when they are in their use positions and to minimize exposure of the valves to damage by persons using the tent.

11. A mattress as described in claim 8, in which each of said first, second, and third sections has an inflation valve for separate inflation thereof; said valve of each of said first and second sections being positioned to be proximate to said sidewalls and said portion of said floor area, and said valve of said third section being positioned to be proximate to a side edge of said opening, to facilitate inflation of said first, second, and third sections when they are in their use positions and to minimize exposure of the valves to damage by persons using the tent.

12. A mattress as described in claim 1, in which said first and second sections are shaped and dimensioned to provide a substantially continuous sleeping surface when they are in their use positions and said third section is away from its use position.

13. A mattress as described in claim 12, in which each of said first, second, and third sections has an inflation valve for separate inflation thereof; said valve of each of said first and second sections being positioned to be proximate to said sidewalls and said portion of said floor area, and said valve of said third section being positioned to be proximate to a side edge of said opening, to facilitate inflation of said first, second, and third sections when they are in their use positions and to minimize exposure of the valves to damage by persons using the tent.

* * * * *

UNITED STATES PATENT AND TRADEMARK OFFICE
CERTIFICATE OF CORRECTION

PATENT NO. : 4,835,800

DATED : June 6, 1989

INVENTOR(S) : Terrance D. Johnson

It is certified that error appears in the above-identified patent and that said Letters Patent is hereby corrected as shown below:

Col. 1, line 42, "guilted" should be -- quilted --.

Col. 1, line 55, "compartment" should be -- compartments --.

Col. 1, line 66, "guilted" should be -- quilted --.

Col. 2, line 3, "disclosed" should be -- discloses --.

Col. 2, line 31, "to" should be -- of --.

Col. 3, line 9, "is" should be -- in --.

Col. 3, line 17, "single" should be -- simple --.

Col. 4, line 49, "Seen" should be -- The --.

Col. 5, line 13, "positions" should be -- position --.

Col. 6, line 6, "section" should be -- sections --.

Col. 6, line 11, "comprises" should be -- comprise --.

Col. 6, line 12, after "which", insert -- are --.

Col. 6, line 56, "Althrough" should be -- Although --.

Col. 6, line 57, "discribed" should be -- described --.

Claim 10, col. 8, line 15, "section" should be -- sections --.

Signed and Sealed this

Twenty-second Day of May, 1990

*Attest:*

HARRY F. MANBECK, JR.

*Attesting Officer*

*Commissioner of Patents and Trademarks*